United States Patent [19]

Thangavelu

[11] Patent Number: 4,838,384

[45] Date of Patent: Jun. 13, 1989

[54] QUEUE BASED ELEVATOR DISPATCHING SYSTEM USING PEAK PERIOD TRAFFIC PREDICTION

[75] Inventor: Kandasamy Thangavelu, Avon, Conn.

[73] Assignee: Otis Elevator Company, Farmington, Conn.

[21] Appl. No.: 209,744

[22] Filed: Jun. 21, 1988

[51] Int. Cl.[4] ..... B66B 1/20

[52] U.S. Cl. ..... 187/125; 187/127

[58] Field of Search ..... 187/124, 125, 127, 130, 187/132

[56] References Cited

U.S. PATENT DOCUMENTS

| | | | |
|---|---|---|---|
| 4,023,135 | 5/1977 | Hanmura et al. | 340/1 R |
| 4,030,572 | 6/1977 | Kaneko et al. | 187/125 |
| 4,112,419 | 9/1978 | Kinoshita et al. | 187/131 |
| 4,244,450 | 1/1981 | Umeda et al. | 187/124 |
| 4,303,851 | 12/1981 | Mottier | 235/92 PK |
| 4,305,479 | 12/1981 | Bittar et al. | 187/125 |
| 4,323,142 | 4/1982 | Bittar | 187/127 |
| 4,330,836 | 5/1982 | Donofrio et al. | 187/131 |
| 4,363,381 | 12/1982 | Bittar | 187/127 |
| 4,411,338 | 10/1983 | Kuzunuki et al. | 187/124 |
| 4,458,787 | 7/1984 | Uetani | 187/127 |
| 4,473,134 | 9/1984 | Uetani | 187/124 |
| 4,499,975 | 2/1985 | Tsuji | 187/125 |
| 4,503,941 | 3/1985 | Takabe | 187/128 |
| 4,523,665 | 6/1985 | Tsuji | 187/127 |
| 4,524,418 | 6/1985 | Araya et al. | 187/127 X |
| 4,536,842 | 8/1985 | Yoneda et al. | 187/127 X |
| 4,542,463 | 9/1985 | Uetani | 187/127 X |
| 4,553,639 | 11/1985 | Uetani | 187/131 |
| 4,562,530 | 12/1985 | Umeda et al. | 364/148 |
| 4,567,558 | 1/1986 | Umeda et al. | 364/148 |
| 4,612,624 | 9/1986 | Tsuji | 364/581 |
| 4,663,723 | 5/1987 | Umeda | 187/125 X |
| 4,672,531 | 6/1987 | Uetani | 187/124 X |
| 4,677,577 | 6/1987 | Takabe et al. | 187/124 X |
| 4,691,808 | 9/1987 | Nowak et al. | 187/125 |

OTHER PUBLICATIONS

Forecasting Methods and Applications by Spyros Makridakis and Steven C. Wheelwright (John Wiley & Sons, Inc., 1978), Sections 3.3: "Single Exponential Smoothing", 3.6: Linear Exponential Smoothing and 3.5 Linear Moving Averages.

*Primary Examiner*—William M. Shoop, Jr.
*Assistant Examiner*—W. E. Duncanson, Jr.

[57] ABSTRACT

Elevator system with multiple cars (1–4) and a group controller (32) having signal processing means (CPU) controlling car dispatching from the lobby (L). During peak conditions (up-peak, down-peak and noontime), each car is dispatched and assigned to hall call floors having a large predicted number of passengers waiting on priority basis, resulting in queue length and waiting time at the lobby and upper floors being decreased, and system handling capacity increased. Estimations of future traffic flow levels for the floors for five minute intervals are made using traffic levels measured during the past few time intervals on that day as real time predictors, using a linear exponential smoothing model, and traffic levels measured during similar time intervals on previous similar days as historic traffic predictors, using a single exponential smoothing model. Combined prediction is used to assign hall calls to cars on priority basis for those floors having predicted high level of passenger traffic to limit maximum waiting time and car load. Noontime priority scheme is based on multiple queue sizes and percentages of maximum waiting time limits. Different waiting time limits can be used for lobby and above lobby up and down hall calls with automatic adjustment. During up-peak the lobby is given high priority. The lobby queue is predicted using passenger arrival rates and expected car arrival times. Down-peak operation uses multiple queue levels and percentages of waiting time limits, with estimated queues based on passenger arrival using car-to-hall-call travel time.

27 Claims, 4 Drawing Sheets

MACHINE ROOM "MR"
MAIN FLOOR (LOBBY) "L"
FROM 40
PL
GROUP CONTROL
CPU
32
POS...CC
POS...CC
DRIVE & MOTION CONTROL
CPU
30
HC
LW
SI
CC
U
D
12
14
16
18
1
2
3
4
2-5
5-9
10-13

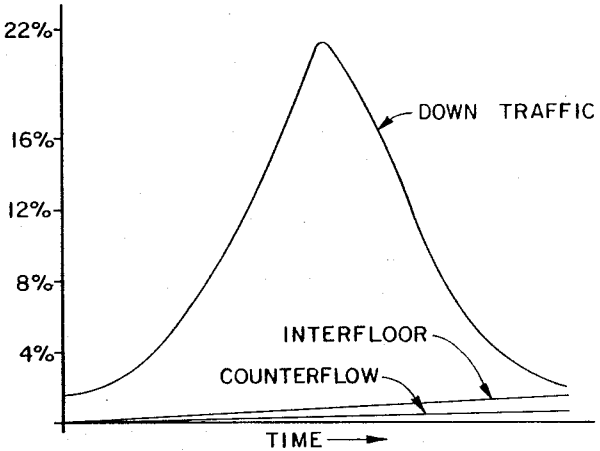
FIG. 2B DOWNPEAK
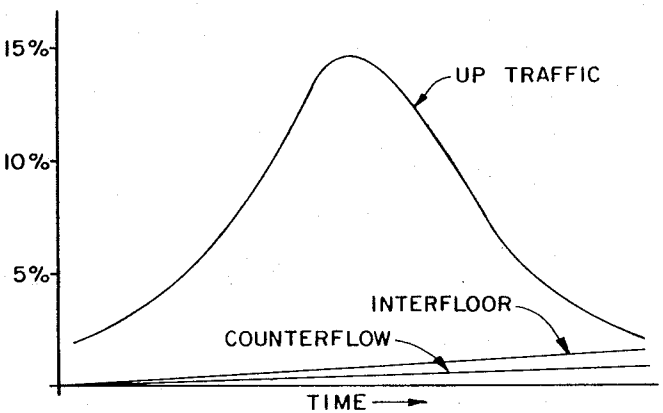
FIG. 2A UP PEAK TRAFFIC
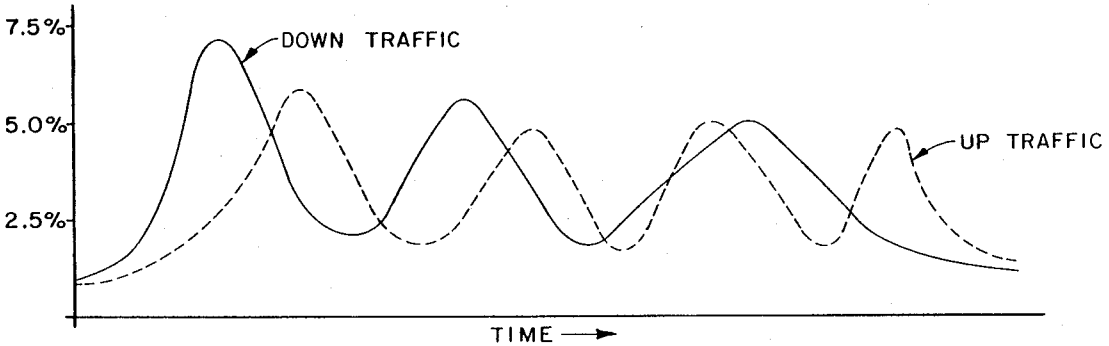
FIG. 2C NOON TIME TRAFFIC VARIATION

QUEUE BASED ELEVATOR DISPATCHING SYSTEM USING PEAK PERIOD TRAFFIC PREDICTION

REFERENCE TO RELATED APPLICATIONS

This application relates to the some of the same aspects in elevator dispatching systems, namely the use of, for example, exponential smoothing models in passenger traffic, as co-pending application Ser. No. 07/209,745 filed on even date herewith, entitled "Optimized 'Up-Peak' Elevator Channeling System With Predicted Traffic Volume Equalized Sector Assignments" of Kandasamy Thangavelu, the inventor hereof, also assigned to Otis Elevator Company the disclosure of which is incorporated herein by reference.

This application also relates to the some of the same aspects in elevator dispatching systems, namely the use of relative system response factors in assigning hall calls to cars, as assignee's co-pending application Ser. No. 07/192,136 filed on or about May 9, 1988, entitled "Weighted Relative System Response Elevator Car Assignment System With Variable Bonuses & Penalties" of Joseph Bittar.

1. Technical Field

The present invention relates to the dispatching of elevator cars in an elevator system, which contains a plurality of cars providing group service to a plurality of floors in a building, and more particularly to a computer based system for optimizing the dispatching of the elevator cars during "peak" periods. The present invention even more particularly relates to a queue based elevator dispatching system using peak period traffic prediction varyingly based on "real time" data and "historic" data 2. Background Art

General Introduction

During peak periods for an elevator system, the lobby generated and/or lobby oriented traffic is usually large and establishes the design requirements and peak period service characteristics for that system.

In the "up-peak" period, large amounts of passenger traffic originate at the lobby and terminate at the upper floors, with multiple passengers boarding each car at the lobby and multiple passengers de-boarding the car at most upper floor car stops. In the "down-peak" period, the passenger traffic from the upper floors to the lobby is large, again resulting in multiple passengers boarding at most hall call stops and multiple passengers de-boarding at the lobby. In the noontime, the lobby oriented down traffic and the lobby generated up traffic are large at different times, resulting in multiple passenger boarding and de-boarding at the lobby and at most upper floor stops for this traffic.

Since the demand on the system is large during peak periods, the number of cars required and their capacity usually are selected based on peak period demand. Thus, peak period operation requires special dispatch strategies to minimize average and maximum waiting times and service times, while achieving high handling capacity.

The current relative system response (RSR) algorithm assigns cars to hall calls with no consideration to the number of people waiting behind hall calls and how long they have been waiting. When more people wait for longer time periods, the average waiting time in the system increases. When long waiting times are not controlled, the maximum waiting time in the system and the variance in waiting time are large.

Such large average waiting time and large variance in waiting time are unacceptable from the user's point of view, and hence system acceptability can be considerably improved by reducing the average waiting time and variance in waiting time.

The RSR algorithms of U.S. Pat. No. 4,363,381 of bittar and of the above referred to application Ser. No. 07/192,436 on May 9, 1988 assign cars to hall calls without knowing how many people are waiting behind the hall calls and how long they have been waiting.

In the prior RSR algorithms all pending hall calls are treated equally. So the up hall calls are assigned starting from the hall call at the bottom most floor and proceeding to up hall calls at the successive upper floors, until the one at the floor below the top most floor is assigned. Similarly, the down-hall calls are assigned starting from the one at the top most floor and proceeding to down hall calls at each successive lower floor, until the one at the floor above the bottom most floor is assigned.

Thus, in systems having no traffic prediction capability or having no direct means of measuring the actual waiting traffic, there is no way to determine the number of people waiting behind the hall calls. However, not giving consideration to the number of people waiting, giving priority only to long waiting hall calls, results in poor service.

With respect to up-peak periods, in systems using RSR algorithms (U.S. Pat. No. 4,363,381 of Bittar) and variable up-peak dispatching intervals (U.S. Pat. No. 4,305,479 of Bittar), there was no specific consideration given to the number of people waiting at the lobby, in assigning cars to up and down hall calls above the lobby. Hence, the average passenger waiting time was increased, and often there was a large number of people waiting for cars at the lobby. At other times, no consideration was given to the past waiting times of up and down hall calls above the lobby, resulting in large waiting times, especially for down hall calls.

In co-pending application Ser. No. 157,143 entitled "Contiguous Floor Channeling With Up Hall Call Elevator Dispatching" filed Feb. 12, 1988 (U.S. Pat. No. 4,792,019 issued Dec. 20, 1988), each of the up hall calls above the lobby are to a car that has a coincident car call stop at that floor. If no car has a coincident car call stop at that floor, the earliest of the cars going to the upper one-third or two-thirds of the floors is assigned the up hall call. The down hall calls are assigned first to the car scheduled to be reversing at the hall call floor. If no such car can be found, the down hall call is assigned to the earliest of the cars coming from floors above the hall call floor. Only if no such car can be found, a car from below the hall call floor is assigned the hall call.

Thus, this approach also does not consider the number of people waiting for up travel at the lobby during the up-peak period and the past hall call waiting time of the up and down hall calls above the lobby.

All previous dispatchers, it is believed, gave no consideration to the number of people waiting at the lobby and had no capability to estimate the number of people waiting at the lobby. When no consideration is given to the lobby queue of passengers, attempting to limit the maximum waiting time above the lobby degrades performance rapidly, by increasing passenger queue and waiting time at the lobby.

With respect to the down-peak period, as noted above, the RSR algorithm of U.S. Pat. No. 4,363,381 of Bittar assigns down hall calls to cars starting from the down hall call at the top most floor and proceeding to successive lower floors, down to the floor immediately above the bottom most floor in the building. Such a strategy gives priority to down hall calls at the upper floors and can result in relatively poor service to down hall calls in the lower floors, even when sector based operation is used.

General Approach of Invention

The dispatcher strategy of the present invention aims at reducing average waiting time by assigning cars to hall calls which have a larger number of people waiting on a priority basis. It also aims to reduce the maximum waiting time and the variance in waiting time by limiting the expected waiting time to pre-specified limits and giving priority to long waiting hall calls.

In the present invention the number of people waiting behind the hall calls is determined, for example, by using historic and real time data on the number of people boarding cars at the hall call floors for short time intervals and the number of cars answering the hall calls at that floor in that direction for those intervals.

The expected waiting time can be computed knowing the past hall call waiting time and the car-to-hall-call travel time, at the time of hall call assignment to a car.

Thus, the dispatcher system of the present invention uses traffic predictors based, for example, on historic and real time traffic data to determine the number of people waiting behind hall calls during peak periods. Knowing the number of people waiting behind hall calls and expected to be waiting behind hall calls, a priority scheme is established in the assigning of cars to hall calls. Then the past hall call waiting time and the expected car travel time to the hall call floor are used to compute the expected hall call waiting time and to limit it to prespecified limits, which can be varied as a function of traffic volume. This limiting is done in consideration of the number of people waiting behind hall calls at other floors.

Part of the strategy of the present invention is accurate prediction or forecasting of the traffic demands during peak periods. It is noted that some of the general prediction or forecasting techniques of the present invention are discussed in general (but not in any elevator context or in any context analogous thereto) in *Forecasting Methods and Applications* by Spyros Makridakis and Steven C. Wheelwright (John Wiley & Sons, Inc., 1978), particularly in Section 3.3: "Single Exponential Smoothing" and Section 3.6: "Linear Exponential Smoothing."

Disclosure of Invention

The present invention originated from the need to provide good quality service and increase the handling capacity in an elevator system during peak periods, when the demand on the system is unusually high. The methodology of the present invention is applicable to all peak periods—up-peak, down-peak and noontime when often multiple numbers of people wait for hall calls, and the waiting time at certain floors can be large. During off peak periods, when the traffic volume is small and the maximum waiting time is also small, the methodology may or may not be used, as may be desired.

In the present invention, the elevators are dispatched efficiently during peak periods, by collecting traffic data in the building and predicting passenger traffic levels as functions of time, a few minutes before the occurrence of the specific levels, based on the past several similar days' and the current day's traffic data, and dispatching the cars using a priority scheme based on the number of people waiting behind the hall calls and the past or expected waiting times of the hall calls.

Thus, the current invention utilizes methods of lobby oriented or lobby generated traffic data collection at the lobby and upper floors during the "up-peak" period, the "down-peak" period and noontime, in an historic and real time data base, and uses the historic and real time data to predict passenger traffic levels for short time intervals for various periods of the given day.

In the present invention, in the noontime, the system collects lobby generated and lobby oriented traffic data at all floors for short time intervals. Using the data collected on the current day during the immediately past several short intervals of time, such as, for example, three or five minute intervals, and, based on this data, the traffic for the next interval is predicted. This is considered a "real time" prediction and preferably uses a model which tracks the real time data closely, such as for example a linear exponential smoothing model.

The data collected for similar intervals on several past similar days is saved in the historic data base encoded with respect to at least time of day, as well as preferably the day itself. This data preferably is used during an off-peak period to make predictions for the next day. This is "historic" prediction and can use the same model as real time prediction, or a simpler model, such as, for example, an exponential smoothing model.

The number of passengers boarding cars for hall calls, the number of hall call car stops made, the number of passengers de-boarding cars for car calls and the number of car call stops made at various floors for various intervals for lobby generated and lobby oriented traffic are thus collected and predicted.

By combining the historic and real time predictions, optimal predictions are obtained—in real time for each interval, at the start of the interval.

Preferably, the number of people waiting behind a hall call at a floor is predicted as the ratio of the number of people boarding cars at that floor in the hall call direction during that interval to the number of hall call stops made during that interval in that direction. Similarly, the number of passengers de-boarding a car for each car call stop during the interval is predicted as the ratio of the number of people de-boarding the cars for car call stops in that direction to the total number of car call stops made at that floor in that direction during that interval.

The optimally predicted data preferably is used to give priority to floors having a large number of passengers waiting in assigning cars to hall calls and to limit the maximum waiting time and maximum car load. During noontime floors having more than a specified number of passengers waiting will be assigned cars first, before any of the other floors not having this condition. This reduces the average passenger waiting time.

As an alternative, several queue levels, Q1, Q2, . . . Qm, may be selected, with "Qm" being the largest or the maximum selected level. Floors having queues greater than "Qm" (maximum queue) will be assigned cars first. Then floors having queues greater than Qm−1 will be assigned cars, and so on, until Q1 is reached. Thus, floors having queues greater than Q1 will be assigned cars in priority order, before floors having queues less than Q1.

In all of these assignments, the maximum waiting time to any passenger is preferably limited to pre-specified levels. These maximum waiting time limits typically will be different for different floors and different with respect to the particular peak period involved.

If large boarding rates are predicted at certain floors at certain times, more than one car preferably is assigned to answer hall calls. The number of people behind hall calls and the number of people de-boarding per car call stop preferably is used to estimate the car load, based on car calls and hall calls assigned to the car. Cars preferably are assigned to answer hall calls only if the expected load before and after the hall call floors is less than a specified limit based on already assigned hall calls and car calls.

In the up-peak period the present invention assigns the cars to the lobby and up and down hall calls above the lobby by taking into consideration the number of people currently waiting at the lobby, the number of cars already proceeding towards the lobby, the expected queue of people when those cars arrive at the lobby, and the expected queue of people when the car that is a possible candidate for up or down hall call assignment above the lobby reaches the lobby.

This strategy gives more importance to the expected queue of people at the lobby, if the queue is larger than a certain percentage of the car's capacity. When the queue is smaller than this percentage of car capacity, it assigns the car to answer the longest waiting hall calls on a priority basis and then to answer the other hall calls.

In assigning cars for hall calls above the lobby during the up-peak period, the car load constraint is also met for up hall calls. It is assumed, for example, that only one or two people board the car at each up hall call floor above the lobby. So a car which is nearly fully loaded will not stop for a hall call. The down hall calls will not be subjected to the load constraint, as the cars usually are empty and the number of people boarding cars for down hall calls is one or two only.

The approach used for down-peak car assignment to hall calls is similar to that used for noontime. The hall calls are assigned taking into consideration the number of passengers waiting behind the hall calls, the past and expected hall call waiting time and the expected car load.

The present invention is particularly significant in that:

(a) it uses today's real time data to predict real time traffic; and (b) it defines a method to refine predictions by combining today's real time predictions with historic predictions based on the past several similar days, data. The resulting predictions respond to today's variations more rapidly.

A further significant aspect of the present invention is that it preferably does give priority to the floors having a large number of passengers waiting, in dispatching cars during the peak periods. Thus, the lobby or main floor would get preference during the "up-peak" period. During noontime and the "down-peak" periods, the floors having more than a specified number of passengers waiting are assigned cars first, before the other floors. Thus, the algorithm used in the present invention reduces the average waiting time, by rapidly responding to large queues. It also reduces the maximum waiting time and variance in waiting time by giving priority to long waits.

Additionally significant is that the algorithm of the present invention can also use multiple queue levels (Q1, Q2 and Qm . . . ) and can assign cars to floors having queues greater than "Qm" first, before assigning cars to floors having queues greater than "Qm−1."

Other significant aspects of the preferred algorithm of the present invention is that it can and preferably does:

(a) also dispatch more than one car to respond to hall calls, if a large queue is predicted; this algorithm thus can improve performance over the "Relative System Response Elevator Call Assignments" of assignee's U.S. Pat. No. 4,363,381, which did not consider the number of people waiting at various floors; and (b) select maximum allowable waiting time limits for lobby hall calls and for the upper floors' up and down hall calls. In assigning cars to hall calls based on expected passenger queues, the exemplary algorithm also preferably maintains maximum waiting time limits at all floors.

Other features and advantages of significance will be apparent from the complete specification and claims and from the accompanying drawings which illustrate an exemplary embodiment of the invention.

BRIEF DESCRIPTION OF DRAWINGS

FIGS. 2A, 2B & 2C are graphical illustrations showing exemplary variations in traffic during "up-peak", "down-peak" and noontime periods, respectively, of percentage of traffic versus time.

BEST MODE FOR CARRYING OUT THE INVENTION

Exemplary Elevator Application

Figure 1:
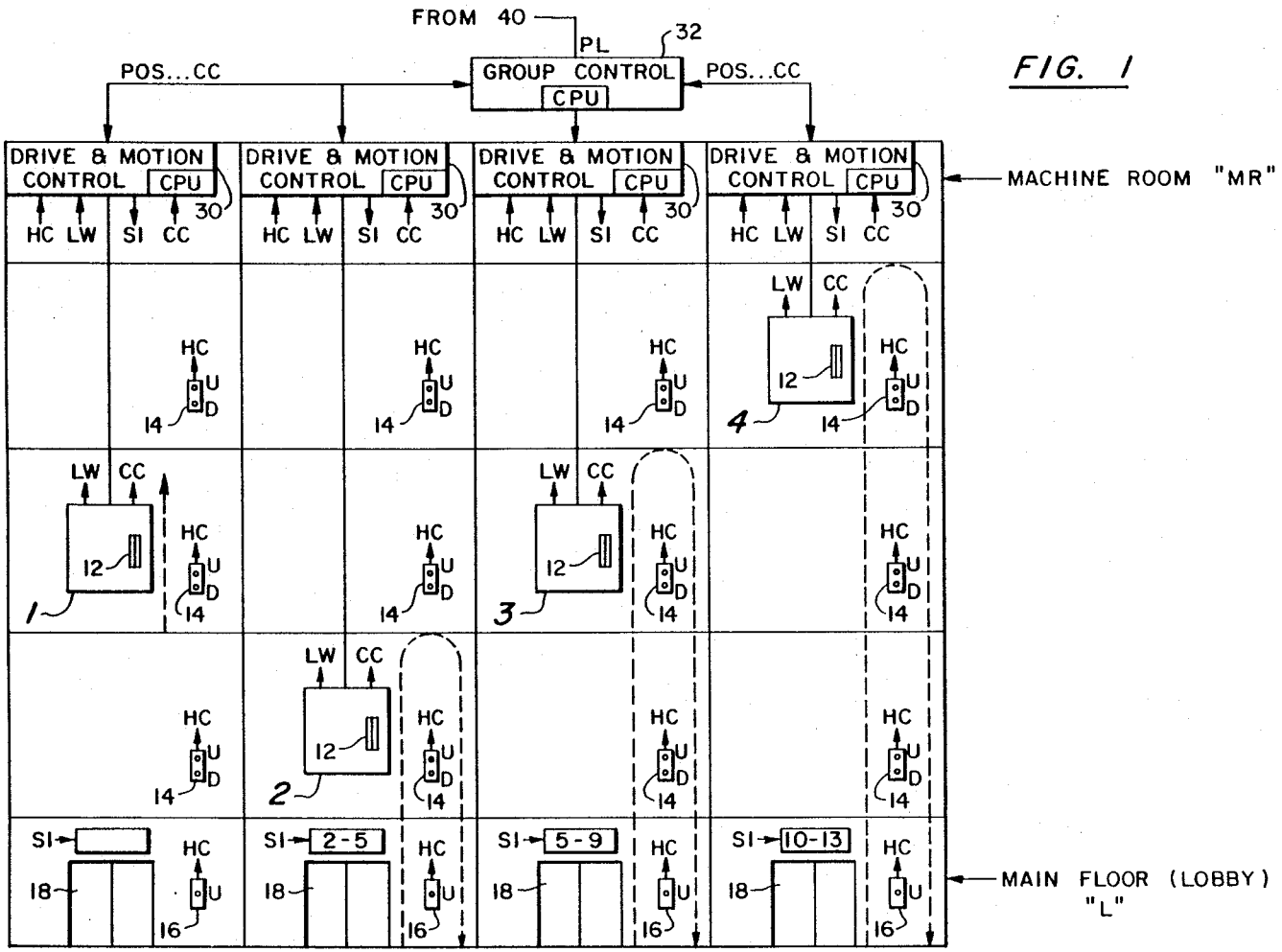
FIG. 1 is a functional block diagram of an exemplary elevator system including an exemplary four car "group" serving an exemplary thirteen floors.

An exemplary multi-car, multi-floor elevator application or environment, with which the exemplary system of the present invention can be used, is illustrated in FIG. 1.

In FIG. 1, an exemplary four elevator cars 1–4, which are part of a group elevator system, serve a building having a plurality of floors. For the exemplary purpose of this specification, the building has an exemplary thirteen floors above a main floor, typically a ground floor lobby "L". However, some buildings have their main floor at the top of the building, in some unusual terrain situations, or in some intermediate portion of the building, and the invention can be analogously adopted to them as well.

Each car 1–4 contains a car operating panel 12 through which a passenger may make a car call to a floor by pressing a button, producing a signal "CC", identifying the floor to which the passenger intends to travel. On each of the floors there is a hall fixture 14 through which a hall call signal "HC" is provided to indicate the intended direction of travel by a passenger on the floor. At the lobby "L", there is also a hall call fixture 16, through which a passenger calls the car to the lobby.

The depiction of the group in FIG. 1 is intended to generally illustrate an elevator system in which cars are assigned to hall calls during peak conditions in accordance with the invention, all in an operation explained in more detail below in context with the logic flow chart of FIGS. 3A & 3B.

At the lobby, and located above each door 18, there can be a service indicator "SI" for each car, which shows the current selection of available floors exclusively reachable from the lobby by a car based on the sector assigned to the car. That assignment may change throughout the up-peak period, as explained in assignee's copending application entitled "Optimized 'Up-Peak' Elevator Channeling System With Predicted Traffic Volume Equalized Sector Assignments" referred to above.

As has been noted, the mode of dispatching of the present invention is used during peak periods, including up-peak, down-peak and noontime. At other times of the day, when typically there is more "inter-floor" traffic, different dispatching routines may be used to satisfy inter-floor traffic (it tends to build after the up-peak period, which occurs at the beginning of the work day). For example, the dispatching routines described in the below identified U.S. patents (the "Bittar patents", all assigned to Otis Elevator Company) may be used at other times in whole or in part in an overall dispatching system, in which the routines associated with the invention are accessed during the peak periods:

U.S. Pat. No. 4,363,381 to Bittar on "Relative System Response Elevator Call Assignments", and/or U.S. Pat. No. 4,323,142 to Bittar et al on "Dynamically Reevaluated Elevator Call Assignments."

As in other elevator systems, each car 1–4 is connected to a drive and motion control 30, typically located in the machine room "MR". Each of these motion controls 30 is connected to a group control or controller 32. Although it is not shown, each car's position in the building would be served by the controller through a position indicator as shown in the previous Bittar patents.

The controls 30, 32 contain a CPU (central processing unit or (signal processor) for processing data from the system. The group controller 32, using signals from the drive and motion controls 30, computes the relative system response measure for each car to answer the hall call, as described in U.S. Pat. No. 4,363,381 of Bittar. Each motion control 30 receives the "HC" and "CC" signals and, if such is included, provides a drive signal to the service indicator "SI". Each motion control also receives data from the car that it controls on the car load "LW". It also measures the lapsed time while the doors are open at the lobby (the "dwell time", as it is commonly called). The drive and motion controls are shown in a very simplified manner herein because numerous patents and technical publications showing details of drive and motion controls for elevators are available for further detail.

The "CPUs" in the controllers 30, 32 are programmable to carry out the routines described herein to effect the dispatching operations of this invention at a certain time of day or under selected building conditions, and it is also assumed that at other times the controllers are capable of resorting to different dispatching routines, for instance, the routines shown in the aforementioned Bittar patents.

Owing to the computing capability of the "CPUs", this system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and lobby traffic may also be analyzed through signals "LW", from each car, that indicates the car load.

Actual lobby traffic may also be sensed by using a people sensor (not shown) in the lobby. U.S. Pat. No. 4,330,836 to Donofrio et al on an "Elevator Cab Load Measuring System" and U.S. Pat. No. 4,303,851 to Mottir on a "People and Object Counting System", both assigned to Otis Elevator Company, show approaches that may be employed to generate these signals. Using such data and correlating it with the time of day and the day of the week and the actual entry of hall calls, a meaningful demand demograph can be obtained for assigning cars to hall calls throughout the peak periods in accordance with the invention by using signal processing routines that implements the sequences described in the logic flow charts of software blocks of FIGS. 3A & 3B, described more fully below, in order to minimize the queue length and waiting time of the passengers placing hall calls.

Figure 3A:
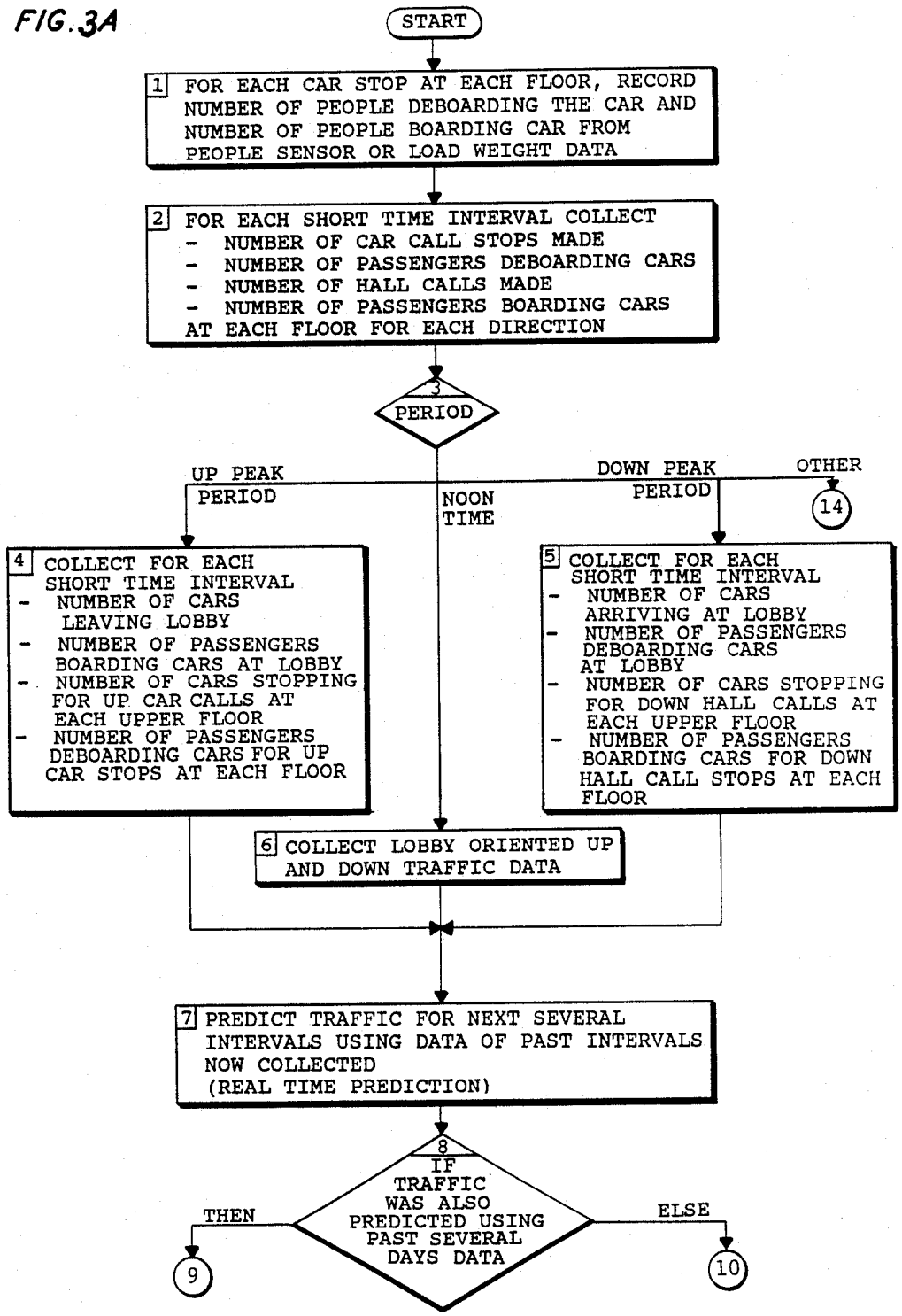
FIGS. 3A & 3B, combined, is a logic flow chart diagram of software blocks illustrating the logic for predicting peak period traffic in accordance with the present invention.
Figure 3B:
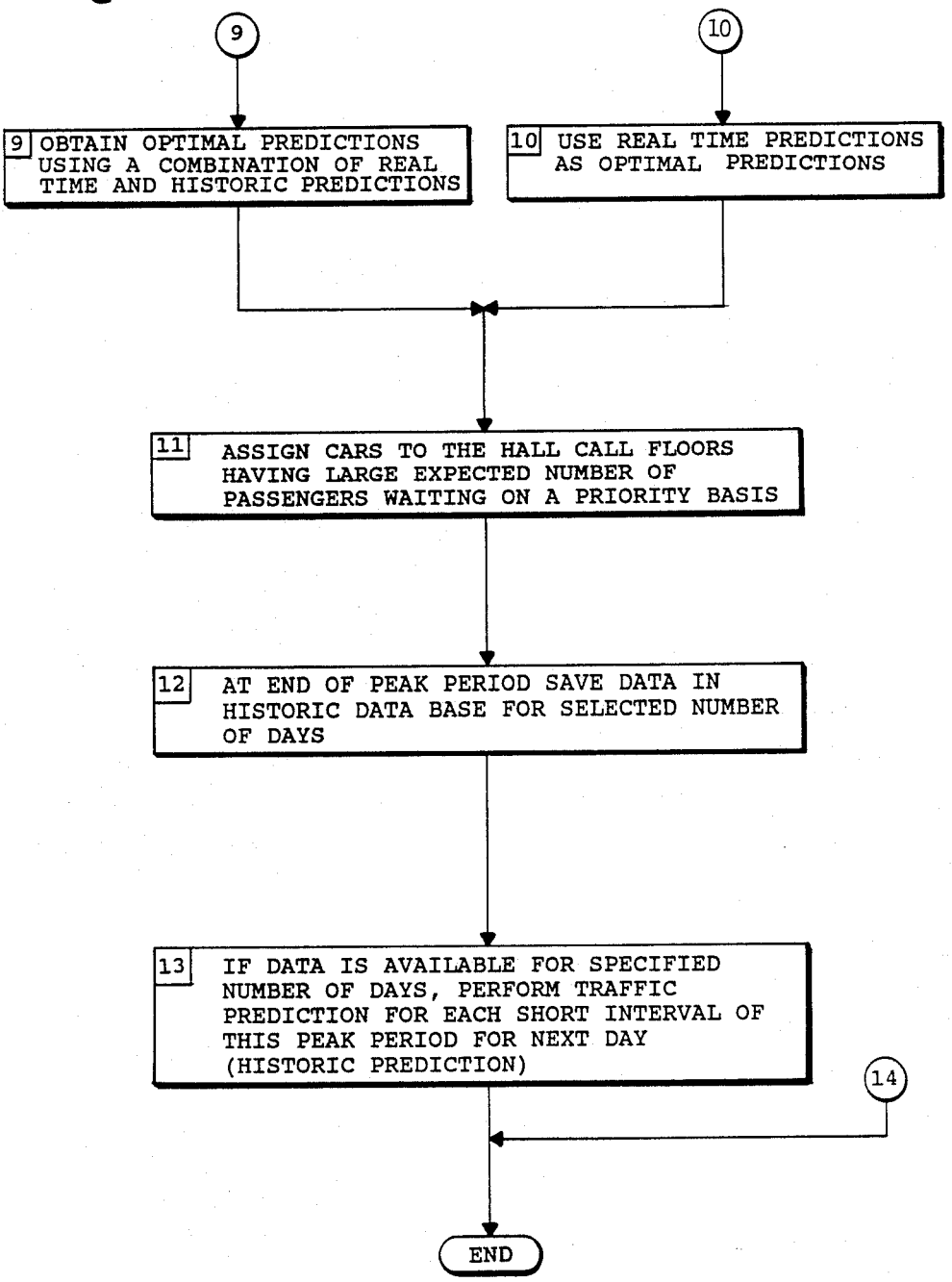

In discussing the dispatching of cars to hall calls using the assignment scheme or logic illustrated in FIGS. 3A & 3B, it is assumed (for convenience) that the elevator cars 1–4 are moving throughout the building, eventually returning to the lobby (the main floor serving the upper floors) to pick up passengers.

Exemplary Dispatching System of Invention

As noted above, the present invention originated from the need to provide good quality service and increase handling capacity during up- and down-peak periods and noontime, when the demand on the elevator system is usually high.

As can be seen in the graphs of FIGS. 2A–2C, during the "up-peak" period, passenger traffic traveling from the lobby to the upper floors is large, while, during the "down-peak" periods, traffic from the upper floors to the lobby is large. During these periods, the counter flow and inter-floor traffic are small, and an assumption of one or two passengers boarding per hall call stop and one or two passengers de-boarding per car call stop is usually adequate. Thus, typically, it is necessary to collect data only on the lobby generated or lobby oriented traffic for short intervals and from that data predict the expected traffic. This is true for the noontime period also.

The traffic in the "up-peak" and "down-peak" periods vary with time, as is shown in the graphs of FIGS. 2A–2C. In single purpose office buildings, the peak period traffic has more or less the same pattern of variation with time each work day. Similarly, the traffic variation during noontime is also similar from day to day.

So it is sufficient to collect passengers boarding and de-boarding counts and car hall call and car call stop counts at the lobby and at all floors for lobby oriented and lobby generated traffic for short time intervals for purposes of generating data to make the traffic predictions. The data collected during the past several intervals of the past few minutes of time is saved in the real time data base.

The data is then used, using the principles of the present invention, to predict traffic levels during the next few intervals, using preferably the method of linear exponential smoothing as generally described in the Makridakis/Wheelwright text, Section 3.6. So if the traffic today varies significantly from the previous days' traffic, this variation is immediately used in the predictions. This improves the accuracy of prediction and facilitates better elevator dispatching and a rapid response to today's variations in traffic.

The data collected during various intervals in the peak period is also saved in the historic data base, preferably at least for several similar days. Then the data is used to predict the traffic levels for similar time intervals during peak periods using the method of moving averages or, more preferably, a single exponential smoothing method or model, which model is likewise generally described in the Makridakis/Wheelwright text, Section 3.3. The prediction can be made during off-peak periods and be available for use when needed.

When historic predictions are available, the historic prediction "$x_h$" and real time predictions "$x_r$" preferably are be combined in real time to obtain the optimal predictions "X". A linear function, such as the following, is preferably used:

$$X = ax_h + bx_r$$

where "X" is the combined prediction, "$x_h$" is the historic prediction and "$x_r$" is the real time prediction for the specified period, such as, for example, a five (5) minute interval, and "a" and "b" are multiplication factors, whose summation is unity ($a+b=1$). The relative values of these multiplication factors preferably are selected as described below, causing the two types of predictors to be relatively weighted in favor of one or the other, or given equal weight if the multiplication factors are equal, as desired, for optimum accuracy.

The relative values for "a" & "b" can be determined as follows. When a peak period starts, the initial predictions can assume that $a=b=0.5$. The predictions are made at the end of each minute, using the past several minutes data for the real time prediction and the historic prediction data.

The predicted data for, for example, six minutes is compared against the actual observations at those minutes If at least, for example, four observations are either positive or negative and the error is more than, for example, twenty (20%) percent of the combined predictions, then the values of "a" & "b" are adjusted This adjustment is made using a "look-up" table generated, for example, based on past experience and experimentation in such situations. The look-up table provides relative values, so that, when the error is large, the real time predictions are given increasingly more weight. An exemplary, typical look-up table is presented below.

| | Values for | |
|---|---|---|
| Error | a | b |
| 20% | 0.40 | 0.60 |
| 30% | 0.33 | 0.67 |
| 40% | 0.25 | 0.75 |
| 50% | 0.15 | 0.85 |
| 60% | 0.00 | 1.00 |

These values would typically vary from building to building and may be "learned" by the system by experimenting with different values and comparing the resulting combined prediction against the actual, so that, for example, the sum of the square of the error is minimized. Thus, the prediction factors "a" & "b" preferably are adaptively controlled or selected.

The combined prediction is made in real time, and the inclusion of real time prediction in the combined prediction results in a rapid response to today's variation in traffic.

The optimally predicted data preferably is used to give priority to floors having a large number of passengers waiting in assigning cars to hall calls subject to maximum waiting time limits. The lobby automatically will then get high priority during the "up-peak" period. During noontime and "down-peak" periods, floors having more than a specified number of passengers waiting will be assigned cars first before any of the other floors not having these conditions. This reduces the average passenger waiting time.

The dispatching aspect of the present invention will now be generally disclosed with respect to each type of peak period involved.

NoonTime

To apply the techniques of the present invention to modifying the application of RSR described in U.S. Pat. No. 4,363,381 and the application filed on May 9, 1988 (Ser. No. 07/192,436), the below steps can be followed.

For each cycle of cyclical assignment:

First check each up hall call and determine the past waiting time and estimate the number of people waiting behind the hall call. The number of people waiting behind the hall call equals the number of people boarding the car during the interval from that floor in the hall call direction divided by number of hall call stops made during that interval in that direction. This is the expected queue size.

For the up hall calls select one maximum waiting time limit for lobby and another for the upper floors. For example during noontime maximum waiting time may be, for example, forty seconds (40) for all hall calls.

Select a limiting queue size. This may be a given percent of the car capacity, e.g. thirty-three percent (33%). Assuming an average weight per person of 165 lbs, for a 2,500 lb. car this would be, for example, five, for a 3,500 lb. car this would be seven, and for a 4,500 lb. car this would be nine. The limiting queue size may also be selected without regard to car size by using some reasonable standard, e.g. five persons.

Check the up hall calls one by one. If the past waiting time of hall call exceeds a pre-specified percent of the maximum allowable limit, for example eighty (80%) percent of the limit, or the queue size exceeds the limiting queue size selected above, first assign a car to these hall calls.

To select the car to be assigned to the hall call, compute the RSR value for each car and select the car with the lowest RSR, as explained in U.S. Pat. No. 4,363,381 and co-pending application filed May 9, 1988 (Ser. No. 07/192,436)

Then compute the expected car load at this hall call floor. The expected car load equals the current car load plus the total number of people expected to be boarding the car at each previously assigned hall call floor, before this current hall call floor, minus the total number of people expected to be de-boarding the car at each previously scheduled car call floor before this current car call floor.

If this expected car load is less than, for example, sixty-five (65%) percent of car capacity, the car can be assigned to this hall call. Then compute the car load after the car answers this hall call. If the car load is less than, for example, eighty (80%) percent of the capacity, the car is eligible for hall call assignment.

Then compute the expected waiting time at all hall calls previously assigned to this car beyond the current hall call floor, if the car makes the current hall call stop. If this waiting time is less than the maximum allowable waiting time for that hall call, the car is eligible for assignment.

Then compute the car load after each of those previously assigned hall calls. If the car load is less than eighty (80%) percent of car capacity, the hall call can be assigned to the car. When the car thus is eligible for assignment, select the car for this hall call.

If the car with the lower RSR is not eligible for assignment, then consider the other cars, starting with the car with the next higher value of RSR. Thus a car which satisfies waiting time and load constraint and has the least RSR is selected for assignment to the hall call.

A car may meet the waiting time constraint, but may not meet load constraint because the queue length at the hall call floor is large. If so, if the car has no more hall calls assigned beyond this hall call and if the car with next higher RSR will reach the floor at least, for example, ten seconds after this car, then assign the current car to this hall call. Reduce the queue length by the difference between 80% of car capacity and the car load before the car reaches the hall call floor. If the remaining queue length is more than, for example, two persons, assign another car with a higher RSR value also for the same hall call, meeting the waiting time and load constraints.

Having assigned cars to the hall calls having queue length greater than the specified limit and waiting time greater than the specified percent of maximum waiting time limit, assign cars to all other up hall calls using the RSR algorithms of U.S. Pat. No. 4,363,381 and the co-pending application filed May 9, 1988 (Ser. No. 07/192,436) and meeting the waiting time and load constraints as explained above.

Then check the down hall calls one by one and determine the past hall call waiting time and the number of people waiting behind the hall call. Select the typical maximum waiting time limit for down hall calls of, for example, forty (40) seconds in noontime. First assign cars to hall calls having queue length greater than the specified limit and a waiting time greater than the specified percent of maximum waiting time limit, as done for the up hall calls. Then assign cars to all other down hall calls, always meeting the waiting time and load constraints as described above.

When cars answer the hall call, note the hall call waiting time. If the hall call waiting time exceeds the maximum waiting time limit, count it as a waiting time limit violation. At the end of the specified interval, determine the number of waiting time violations. If the violations are more than, for example five (5%) percent of the number of hall calls answered in that direction at all floors above the lobby, increase the maximum waiting time limit by, for example, five seconds. Save the maximum waiting time limit for each interval for each hall call direction in look-up tables for use on succeeding days.

If the number of violations is less than, for example, one percent of the hall calls answered, then decrease the maximum waiting time limit by, for example, five seconds for that interval in that hall call direction and save it in look-up tables. Thus, the maximum allowable waiting time for the lobby, for up hall calls above the lobby and down hall calls above the lobby, are adaptively "learned" by the system.

As an alternative, several queue levels, Q1, Q2, . . . Qm may be selected, with "Qm" being the largest or the maximum selected level. Floors having queues greater then "Qm" (maximum queue) will be assigned cars first. Then floors having queues greater than Qm−1 will be assigned cars, and so on, until Q1 is reached. Thus, floors having queues greater than Q1 will be assigned cars in priority order, before floors having queues less than Q1.

Thus, for example, in this alternate method, instead of using one limiting queue size and one specified percent of a maximum waiting time limit, to give priority to car assignment to hall calls, multiple limiting queue sizes and multiple maximum waiting time percentages are used to implement the priority scheme. For example, five different queue size limits may be selected, using for exemplary values twelve, nine, six, four and two. Two different maximum waiting time percentages are selected.

Then a priority scheme is selected, an example of which is presented below:

| | Priority | Queue Size | % of Max. Waiting Time |
|---|---|---|---|
| Highest | p0 | >12 | — |
| | p1 | >9, <12 | — |
| | p2 | >6, <9 | — |
| | p3 | >4, <6 | 80% |
| | p4 | >2, <4 | 60% |
| Lowest | p5 | <2 | — |

Thus, the past waiting time of the hall call is also used to select different priority levels. Then, while assigning up halls using RSR algorithms, all hall calls are checked and the number of passengers behind each hall call and the hall call past waiting time determined. Then based on these two values and the above selected priority scheme, the priority level (P0, P1 . . . P5) to be assigned to each hall call is determined and saved in the data base.

The hall calls with priority level "P0" are checked one by one and assigned to cars first using a minimizing of the RSR value and maintaining the maximum car load and the maximum hall call waiting time constraints, as previously explained. Then hall calls with a "P1" priority are assigned one by one again using the above three criteria. The hall calls with priority levels "P2", "P3" and "P4" are assigned in that order. The hall calls with the lowest priority "P5" are assigned last.

The above scheme thus gives higher priority to large queues than to hall calls waiting more than eighty (80%) percent or sixty (60%) percent of the maximum allowable waiting times. The number of limiting queues selected may be, for example, two, three, four or five, etc., and the number of percentages of maximum allowable waiting times may, for example, be one or two.

During noontime the down hall calls are assigned after all of the up hall calls are assigned.

The assignment scheme will also assign more than one car to a hall call, if the expected number of people waiting behind a hall call can not be handled by one car.

In a modification to the above scheme, the decision to assign up hall calls first and then down hall calls, or vice versa, is made, for each exemplary three (3) or five (5)

minute interval, based on if the total predicted up passenger traffic is larger than the total predicted down passenger traffic or vice versa.

Up-peak Period

Before up-peak starts, the number of people boarding cars at the lobby during each short interval is collected for several intervals and saved in the data base. So the real time traffic prediction is made for each short interval using the past intervals, data and, for example, a linear exponential smoothing model. The traffic data is also collected for similar intervals for several similar days and used to make historic predictions, i.e. during off-peak periods using, for example, an exponential smoothing model. By combining the two, optimal predictions are made as explained above.

So when up-peak starts, the expected number of people accumulated at the lobby is calculated at the end of, for example, fifteen second intervals for, for example, two minutes from the current clock time. The expected number of people at the end of interval "i" equals the expected number of people at the end of interval (i−1) plus the average three minute passenger arrival rate, for the interval divided by twelve (12).

The average passenger arrival rate for three minutes is computed knowing the arrival rate for one three-minute interval and the arrival rate for the next three-minute interval, using appropriate linear interpolation or extrapolation.

When the cars leave the upper floors for the lobby as their final destination, their arrival time at the lobby is calculated and saved in a table. The expected queue length at the end of the next fifteen second interval is decremented by the average loading rate at the lobby, e.g. sixty-five (65%) percent of car capacity. For an exemplary twenty-two passenger car this would be fourteen.

The up and down hall calls above the lobby preferably are assigned in one cycle of assignment. When a hall call is to be assigned, all cars are checked and the car with the lowest RSR or the car that serves upper $\frac{2}{3}$ or $\frac{1}{3}$ landings is identified. If the car already has the lobby as its final destination and, when the car comes to the lobby, the expected queue for the car will be at least 65% of the car capacity, the car is not considered for the assignment. So only those cars that will have waiting queues of less than 65% of car capacity preferably are considered for assignment. If no such car is available, if the passengers waiting time exceeds the prespecified maximum waiting time limit, typically fifty (50) seconds for an up hall call and sixty (60) seconds for a down hall call, only the car with the lowest RSR or serving the upper $\frac{1}{3}$ or $\frac{2}{3}$ sections is assigned to answer the hall call. The waiting time violation is recorded.

At the end of each exemplary five minute interval the number of times the waiting time limits are violated is checked for up and down hall calls separately. If the number of times waiting time limits are violated is, for example, at least three for the five minute interval, the maximum waiting time limit is incremented by, for example, five seconds. If it is none, the maximum waiting time limit is decremented by, for example, five seconds.

If, when a hall call above the lobby is to be assigned, the car selected for assignment has not yet been assigned the lobby as its final destination (the car is still on the up trip), the car's arrival time at the lobby is calculated, assuming the car to reverse on reaching the topmost car call floor and go straight to the lobby. Then the expected number of people waiting for the car, when it arrives at the lobby, is computed. If the expected number of people waiting for the car is more than, for example, 65% of car capacity, then the car is not eligible for assignment for the up hall call; otherwise it can be assigned the up hall call.

By giving consideration to passengers waiting at the lobby, the average waiting time and queue length are reduced. By giving consideration to the maximum waiting time limit, if a car is available which has few people waiting for it at lobby, it serves the hall calls above the lobby. If no such car is available, an automatic method for increasing the waiting time above the lobby preferably is incorporated.

In a variation of this scheme, for every two or three increases in maximum allowable waiting time limit above the lobby, one five percent increase in waiting queue length at the lobby is made. The waiting queue length at the lobby is decreased similarly, if the waiting time limit is decreased above the lobby.

Down-peak Period

While implementing the priority based assignment using waiting queue lengths and past hall call waiting times, for the down-peak period, usually several limiting queue sizes are selected e.g. three, four or five. The maximum waiting time limit is larger in the down-peak period for both down and up hall calls. The down hall calls can have an exemplary waiting time limit of, for example, fifty (50) seconds and up hall calls a limit of sixty (60) seconds.

Also two limiting percentages of maximum waiting time limit are used in selecting priorities. Thus a multiple priority scheme will be used as explained for the "noontime."

The down hall calls are assigned to cars first, starting from the hall call at the top-most floor and proceeding successively, until the hall call at the floor just above the bottom-most floor. The hall calls with priority "P0" is assigned first; then hall calls with priority "P1," then hall calls with priority "P2," etc. The hall calls with the lowest priority are assigned last.

Then only up hall calls above the lobby are assigned. The down hall call assignment maintains the waiting time and load constraints, as explained above under the noontime scheme.

A modification to the above scheme uses not only the number of people already waiting for the hall call and the past hall call waiting time, but also the expected number of people waiting for the hall call and the expected waiting time, when the car arrives at the hall call floor.

In this modified scheme, after the hall calls have been assigned to the cars, as explained above, the time interval between the current clock time and the car arrival time at the hall call floor is computed The expected number of people arriving at the hall call floor for down hall calls during this interval is computed and added to the already waiting passengers Similarly, knowing the car arrival time at the hall call floor, the expected hall call waiting times are computed.

These expected queue lengths and expected waiting times are used to select the priority levels in the next cycle of car assignment to hall calls. So during each successive cycles of car assignment to hall calls, attempts are made to serve the expected longer queues and longer waiting times first, taking into account the car to hall call travel time and the passenger accumulation at the hall call floors during this period.

The above scheme based on predicted queue and waiting time is used only for down hall calls, since the number of people waiting for up hall calls is usually only one or two passengers during the down-peak period.

Of course, as is well known to those of ordinary skill in the art, the controller includes appropriate clock means and signal sensing and comparison means from which the time of day and the day of the week and the day of the year can be determined and which can determine the various time periods which are needed to perform the various algorithms of the present invention.

In greater detail for one exemplary embodiment of the prediction logic and with particular reference to the logic steps of FIGS. 3A & 3B at the start, in Step 1, for each car stop at each floor, the number of people de-boarding the car and the number of people boarding the car is recorded, based on, for example, either a people sensor or from load weight data. In Step 2, for each short time interval, for example, every five (5) minutes, the following numerical information is collected and stored for each floor in each direction the number of car call stops made,
the number of passengers de-boarding the cars,
the number of hall calls made, and
number of passengers boarding the cars.

In Step 3 a check is made to determine whether any peak conditions are present. If not, then the logic process is ended (Step . 14). Otherwise, depending on whether the peak period is an up-peak period, a down-peak time period or a noontime period, Steps 4, 5 or 6, respectively, is performed.

If an up-peak period is in effect, in Step 4 the following numerical information is collected and stored for each small time interval the number of cars leaving the lobby (or main floor),
the number of passengers boarding the cars at the lobby (or main floor),
the number of cars stopping for any up car calls at each upper floor, and
the number of passengers de-boarding the cars for any up car stops at each floor.

If a down-peak period is in effect, in Step 5 the following numerical information is collected and stored for each small time interval the number of cars arriving at the lobby (or main floor),
the number of passengers de-boarding the cars at the lobby (or main floor),
the number of cars stopping for any down hall calls at each upper floor, and
the number of passengers boarding the cars for any down car stops at each floor.

If noontime conditions are present, in Step 6 the lobby generated up traffic and lobby oriented down traffic data listed in Steps 4 & 5 above are collected and stored.

Based on the results of Step 4, 5 or 6, whichever took place, in Step 7 the traffic for the next several intervals using the data of the past intervals is then forecast as "real time" prediction data. If in Step 8 it is determined that the past several days data is available, then in Step 9 the optimal predictions ("X") are obtained using a combination of real time prediction ("$x_r$") and historic prediction ("$x_h$") using, for example, the formula above. Otherwise, in Step 10 only the real time predictions are used for the optimal predictions.

In Step 11 the cars are then assigned on a priority basis to the hall call floors having a large expected number of passengers waiting, using the optimal predictions ("X") obtained in Step 9 or Step 10.

At the end of the peak period, whether up, down or noontime, the data in the historic data base is saved for the selected number of days, for example ten (10) days. Finally, if the data is available for the specified number of days, the traffic prediction for each short interval of this peak period is performed for the next day, serving as an historic prediction.

After the algorithm or logic routine of FIGS. 3A & 3B is ended, it is thereafter restarted and cyclically repeated.

Once predictions are made at the start of the short time interval, the predicted data is used to generate the number of passengers waiting behind the hall calls and the number of passengers de-boarding for each car call stop at each floor for lobby generated and lobby oriented traffic. This data is then used to give priority to long queues and long waited hall calls and to limit car loads while assigning cars to the hall calls, as described above.

It should be understood that the invention is not limited to the particular embodiment(s) shown and described herein, but that various changes and modifications may be made without departing from the spirit and scope of this novel concept as defined by the following claims.

Having thus described at least one exemplary embodiment of the invention, that which is new and desired to be secured by Letters Patent is claimed below:

1. An elevator dispatcher for controlling the assignment of hall calls among a plurality of elevator cars serving a plurality of floors in a building in response to hall calls made during peak time conditions, in association with traffic volume measuring means for measuring the traffic volume on a per floor and per direction basis, characterized by:

signal processing means for providing signals for determining when the system is in a peak time condition, such as up-peak, noontime and down-peak periods, and, when a peak time condition exists, for providing further signals for measuring and collecting passenger traffic data in the building and predicting passenger traffic levels as functions of time, a short period of time before the occurrence of the specific levels, said traffic data including at least that day's real time data of actual passenger traffic;

for determining if historic passenger traffic data is available for at least a past few days similar time period, and, if such historic passenger traffic data is available, including said historic passenger data in predicting passenger traffic levels; and for assigning hall calls to the cars based on the expected passenger queue levels on a floor-by-floor basis and computed waiting time of hall calls in dispatching the cars.

2. The elevator dispatcher according to claim 1, characterized in that said signal processing means further provides signals for:

giving priority to the floors having more than a predicted large number of passengers waiting, by calculating the average number of people waiting for the hall call at each floor and giving priority to long waiting times in dispatching the cars.

3. The elevator dispatcher according to claim 2, characterized in that said signal processing means further provides signals for:

providing multiple queue level values, with the floors having a queue level value greater than another floor being assigned a car sooner.

4. The elevator dispatcher according to claim 2, characterized in that said signal processing means further provides signals for:

assigning multiple cars to a hall call at a floor having a high predicted passenger traffic level.

5. The elevator dispatcher according to claim 1, characterized in that said signal processing means further provides signals for:

comparing the waiting time for all waiting hall calls against a preselected maximum allowed value, which may be different for up-peak, noon and down-peak periods and for lobby calls, up hall calls and down hall calls, and assigning on a high priority basis car(s) to any hall calls having waiting time values exceeding a value based on the preselected maximum value(s).

6. The elevator dispatcher according to claim 1, wherein said passenger volume measuring means includes recording means for recording the number of people deboarding each car and number of people boarding each car during peak conditions, characterized in that said signal processing means further provides signals for:

collecting the number of passengers de-boarding the cars, number of people boarding the cars, number of hall call stops and number of car call stops made at each floor for cyclical short time intervals; and saving the past passenger de-boarding counts, passenger boarding counts, car hall call stop counts and car call stop counts at each floor for lobby generated and lobby oriented traffic in a data base to provide a recent past history of passenger volume.

7. The elevator dispatcher according to claim 6, characterized in that said signal processing means further provides signals for:

predicting passenger de-boarding counts, passenger boarding counts, car hall call stop counts and car call stop counts at each floor for the next short time period of the order of no more than some few minutes using data collected for past like short time periods during that same day providing a real time prediction.

8. The elevator dispatcher according to claim 7, wherein said recording means for recording the number of people de-boarding each car and the number of people boarding each car at least during peak conditions retains the recorded data for each day for at least a period of several similar days and produces historic predictions using the past several days, data, characterized in that said signal processing means further provides signals for:

obtaining optimal predictions combining both real time predictions and historic predictions.

9. The elevator dispatcher according to claim 8, characterized in that said signal processing means further provides signals for:

combining both real time predictions and historic predictions in accordance with the following relationship $$X = ax_h + bx_r$$

where "X" is the combined prediction, "$x_h$" is the historic prediction and "$x_r$" is the real time prediction for the short time period for the floor, and "a" and "b" are multiplying factors.

10. The elevator dispatcher according to claim 9, wherein said multiplying factors added together equal unity and provide relative weighing between the historic prediction and the real time prediction in the combined prediction.

11. The elevator dispatcher according to claim 10, wherein various values of said multiplying factors are provided in a look-up table and provide relative weighing between the historic prediction and the real time prediction in the combined prediction based on a comparison of the amount of error between predictions based on previously assigned values of "a" & "b" and actual observations over a relatively short time period of a few minutes.

12. The elevator dispatcher according to claim 11, wherein "b" is increased in value and "a" is decreased in value as the amount of error increases in the look-up table.

13. The elevator dispatcher according to claim 9, characterized in that said historic prediction of passenger de-boarding counts for the next short time period of said signal processing means is based on:

a single exponential smoothing model.

14. The elevator dispatcher according to claim 7, characterized in that said prediction of passenger de-boarding counts for the next short time period of the order of no more than some few minutes using data collected for past like short time periods during that same day providing a real time prediction of said signal processing means is based on:

a linear exponential smoothing model.

15. The elevator dispatcher according to claim 7, Wherein said short time period is of the order of about a three (3) to five (5) minute interval.

16. The elevator dispatcher according to claim 5, characterized in that said signal processing means further provides signals for:

adjusting the maximum waiting time limits automatically based on the frequency of actual waiting time exceeding specified limits.

17. The elevator dispatcher according to claim 1, characterized in that said signal processing means further provides signals for:

assigning hall calls to the cars also based on the expected load of the car after the hall call is answered; and computing the expected car load after the car answers a hall call and limiting the car load to a specified portion of the car's maximum capacity.

18. The elevator dispatcher according to claim 1, characterized in that said signal processing means further provides signals for:

assigning hall calls to the cars based on giving long queues of waiting passengers at a hall call higher priority over longer waiting time for hall calls with shorter queues.

19. The elevator dispatcher according to claim 1, characterized in that said signal processing means further provides signals for:

estimating the queue length at the lobby at the end of repeating intervals of a very short period of time of the order of some seconds based on the predicted arrival rate of people for each longer period of time of the order of a few minutes during an up-peak period; and adjusting the predicted queue length based on the car arrivals at the lobby and the passenger pick-up by arriving cars during an up-peak period

20. The elevator dispatcher according to claim 19, characterized in that said signal processing means further provides signals for:

giving priority to the lobby over hall calls above the lobby for a car if the expected lobby queue is greater than at least a predetermined level of car capacity of the order of about sixty-five (65%) percent, during an up-peak period.

21. The elevator dispatcher according to claim 1, characterized in that said signal processing means further provides signals for:

when down-peak conditions are present, using multiple queue sizes and multiple percentages of waiting time limits for selecting multiple priorities, with the priorities being selected to minimize average wait time and maximum and variance of wait time.

22. The elevator dispatcher according to claim 21, characterized in that said signal processing means further provides signals for:

giving down hall calls greater priority during down-peak conditions.

23. The elevator dispatcher according to claim 1, characterized in that said signal processing means further provides signals for:

when an up-peak condition is present, assigning up hall calls first and then down hall calls;

when a down-peak condition is present, assigning down hall calls and then up hall calls; and when a noontime condition is present, selecting the order of up and down hall call assignment based on lobby generated up traffic and lobby oriented down traffic.

24. The elevator dispatcher according to claim 1, characterized in that said signal processing means further provides signals for:

computing the waiting time based on the actual waiting time of the hall calls.

25. The elevator dispatcher according to claim 1, characterized in that said signal processing means further provides signals for:

computing the waiting time based on the expected waiting time of the hall calls.

26. The elevator dispatcher according to anyone of claims 1–24 or 25, Wherein said dispatcher is part of an elevator system, said system including a plurality of cars for transporting passengers from a main floor to a plurality of contiguous floors spaced from the main floor;

car call means, one associated with each of said cars, for entering car calls for each car;

car motion control means associated with said cars for moving each car in accordance with the assignment of the hall calls to the cars based on said signals from said signal processing means; and traffic volume measuring means associated with said signal processing means for measuring the traffic volume on a per floor and per direction basis and providing that information to said signal processing means.

27. A method for dispatching elevators from a main floor to other contiguous floors in a building, in association with traffic volume measuring means for measuring the traffic volume on a per floor and per direction basis at least during peak time conditions, in response to hall calls, comprising the following step(s):

(a) utilizing signal processing means for providing signals for determining when the system is in a peak condition, including clock means for determining calendar time with respect to at least the day of the week and the time of the day, and, at least when such peak condition exists, for providing further signals for measuring and collecting passenger traffic data in the building and predicting passenger traffic levels as functions of time, a short period of time before the occurrence of the specific levels, said traffic data including at least that day's real time data of actual passenger traffic;

for determining if historic passenger traffic data is available for at least a past few days'similar time period, and, if such historic passenger traffic data is available, including said historic passenger data in predicting passenger traffic levels; and for assigning hall calls to the cars based on the expected passenger queue levels on a floor-by-floor basis and computed waiting time of the hall calls in dispatching the cars;

(b) at least during peak conditions, utilizing said traffic volume measuring means to measure and collect passenger traffic data in the building a short period of time before the occurrence of the specific levels and, over the course of time, saving the data for at least several days in a data base encoded to at least the time of day the data was taken; and (c) utilizing said signal processing means for predicting passenger traffic levels for a short period of time before the occurrence of the specific level using at least that day's real time data of actual passenger traffic and determining if historic passenger traffic data is available for at least a past few days' similar time period, and, if such historic passenger traffic data is available, including said historic passenger data in predicting passenger traffic levels; and (d) assigning hall calls to the cars based on the expected passenger queue levels on a floor-by-floor basis and the computed waiting time of the hall calls in dispatching the cars.

* * * * *